US006793304B2

(12) United States Patent
Kasahara

(10) Patent No.: US 6,793,304 B2
(45) Date of Patent: Sep. 21, 2004

(54) PRINTING APPARATUS

(75) Inventor: Takashi Kasahara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 192 days.

(21) Appl. No.: 10/126,682

(22) Filed: Apr. 22, 2002

(65) Prior Publication Data

US 2002/0167561 A1 Nov. 14, 2002

(30) Foreign Application Priority Data

Apr. 24, 2001 (JP) ..... 2001-126395

(51) Int. Cl.[7] ..... B41J 29/38
(52) U.S. Cl. ..... 347/5; 347/16
(58) Field of Search ..... 347/5, 9, 16, 139, 347/218, 262; 400/545, 555, 578, 582

(56) References Cited

FOREIGN PATENT DOCUMENTS

| | | |
|---|---|---|
| JP | 3-2068 | 1/1991 |
| JP | 7-52465 | 2/1995 |
| JP | 8-324025 | 12/1996 |
| JP | 9-11509 | 1/1997 |
| JP | 9-24607 | 1/1997 |
| JP | 2001-58433 | 3/2001 |
| JP | 2002-225241 | 8/2002 |

*Primary Examiner*—Michael S. Brooke
(74) *Attorney, Agent, or Firm*—Fitzpatrick, Cella, Harper & Scinto

(57) ABSTRACT

In a printing apparatus having a mechanism for feeding a printing medium relative to the printing head having an array of a plurality of printing elements, when it is necessary to shift the positions of data to be set in the printing elements by an amount smaller than 8 bits, a basic unit used for data processing, according to the printing medium feeding amount determined by a printing resolution, a trouble of re-editing the print data is avoided. To achieve this, 8 bits of blank data are added to the print data to be transferred to the plurality of printing elements and the number of clocks for transferring the print data is reduced by an amount corresponding to the data position shifting. This allows the print data to be freely allocated to the appropriate positions of the printing elements without having to re-edit the data.

11 Claims, 7 Drawing Sheets

PRINTING APPARATUS

This application is based on Patent Application No. 2001-126395 filed Apr. 24, 2001 in Japan, the content of which is incorporated hereinto by reference.

BACKGROUND OF THE INVENTION

1. Field of the Invention

The present invention relates to a printing apparatus which has means for feeding a printing medium relative to a printing head having an array of printing elements, during a printing operation.

2. Description of the Related Art

In a printing apparatus of this kind, for example, a so-called serial printing apparatus which carries the printing head relative to a printing medium in a direction different from that of the array of the printing elements (main scan operation) and also feeds between the main scan operations the printing medium relative to the printing head in a direction perpendicular to the main scan direction (sub-scan operation) to perform printing of an image, there may be a case where a feeding amount of the printing medium between the main scan operations is set smaller than a printing element pitch in the printing head to realize a higher resolution than the printing element pitch. Setting the feeding amount to a smaller value, however, makes an overall feeding speed that much slower, resulting in a lowered throughput of the printing apparatus. Hence, it is a conventional practice to set the feeding amount as a sum of an amount of arranging width of a predetermined number of printing elements, which are arranged at a predetermined pitch, and an amount shorter than the printing element pitch, prepare a plurality of different feeding amounts, and combine these different feeding amounts as required, thereby striking a balance between a high resolution and a throughput.

For the printing operation, print data representing an image to be printed is mapped in print buffers associated with print dot forming positions in the main scan and sub-scan directions and, as the printing operation proceeds, the print data is transferred to the printing elements.

In a printing apparatus of a construction described above that realizes a higher resolution than the printing element pitch, two buffers are provided, one for mapping data that conforms the original printing element pitch and one for mapping interpolated data corresponding to a feeding amount smaller than the printing element pitch. Suppose the original printing element pitch in the printing head is 360 dpi (dots per inch). When the printing elements are located at the positions on the printing medium that match 360 dpi, the printing operation is done based on the data mapped in the print buffer for 360 dpi. When the printing elements are not located at the positions on the printing medium that match 360 dpi as a result of, for example, adjustments made on the feeding amount, the printing is performed based on data of the other print buffer in which the data is arranged to interpolate the 360-dpi print positions. With this control, if the feeding amount is set by adding 1/720 inch to an integer multiple of 1/360 inch, 720-dpi printing can be realized even when a printing head has a printing element pitch of 360 dpi.

The conventional printing apparatus described above, however, has the following problems.

1. Since the feeding amount of a printing medium does not necessarily match bytes, basic units used in data processing by computers, it is necessary to reconstruct the print buffers according to a particular feeding amount.

2. Control is complicated, so the software development takes long.
3. Since the print buffer is reconstructed, the processing time and the required capacity of a temporary storage area such as RAM increase.

SUMMARY OF THE INVENTION

The present invention is intended to solve these problems.

In an aspect of the present invention, there is provided a printing apparatus for performing a printing operation by using a printing head having an array of a plurality of printing elements, the printing apparatus comprising:

means for feeding a printing medium relative to the printing head;

feed control means for driving the feeding means to feed the printing medium and for controlling the feeding means to change a feeding amount of the printing medium;

means for transferring print data to the plurality of printing elements to cause the printing head to perform the printing operation; and transfer control means for changing, according to the feeding amount, the number of clocks for transferring the print data.

The printing apparatus may comprise means for scanning the printing head relative to the printing medium in a direction different from that of the array of the printing elements, and wherein the feeding means may feed the printing medium in a direction perpendicular to the scanning direction.

The feed control means may change the feeding amount according to a resolution of printing.

The feed control means enables to set a driving amount of the feeding means to match a feeding amount less than a pitch of the printing elements in the printing head added to an integer multiple of the printing element pitch. Here, a plurality of kinds of the driving amount are provided. Further, the feed control means may be capable of combining a plurality of kinds of the driving amount.

In the above aspect of the present invention, when shifting the positions of data to be set in the plurality of printing elements by an amount less than a predetermined value in response to the changing of the feeding amount, the transfer control means may add a predetermined amount of blank data to the print data to be transferred and may reduce the number of clocks by an amount corresponding to the data position shifting. Here, the predetermined value may be 8 bits, a unit used for data processing.

In the above aspect of the present invention, the printing head may be in the form of an ink jet printing head for performing printing by ejecting an ink. Here, the ink jet printing head may have heating elements for generating thermal energy to make the ink to film-boil, as an energy for ejecting the ink.

Incidentally, in the present specification, "printing" means not only a condition of forming significant information such as characters and drawings, but also a condition of forming images, designs, patterns and the like on printing medium broadly or a condition of processing the printing media, regardless of significance or lack of meaning or of being actualized in such manner as to be visually perceived by a human.

Further, the "printing medium" means not only a paper used in a conventional printing apparatus but also everything capable of accepting inks, such as fabrics, plastic films, metal plates, glasses, ceramics, wood and leathers, and in the following, will be also represented by "paper".

Further, the term "ink" should be interpreted in a broad sense like the definition of "printing" above and thus the ink, by being applied on the printing media, shall mean a liquid to be used for forming images, designs, patterns and the like, processing the printing medium or processing inks.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described in detail by referring to the accompanying drawings.

Figure 1:
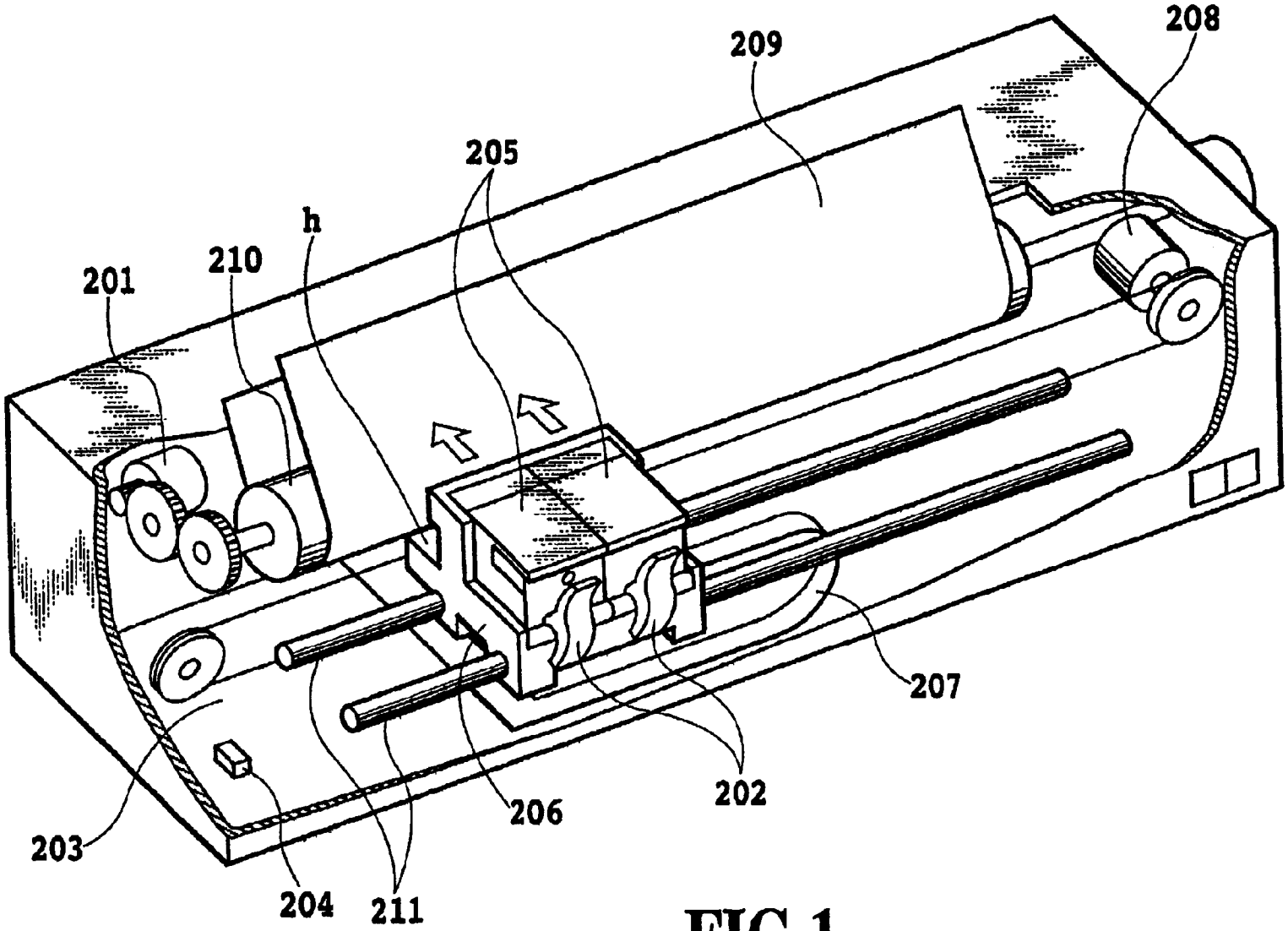
FIG. 1 is a schematic perspective view showing an example construction of an essential part of a serial type ink jet printing apparatus as a printing apparatus to which the present invention can be applied.

FIG. 1 is a schematic perspective view showing an example construction of an essential part of a serial type ink jet printing apparatus as a printing apparatus to which the present invention can be applied.

In FIG. 1, reference numeral 205 represents a head cartridge that is replaceably mounted on a carriage 206. The head cartridge 205 is fixedly mounted on the carriage 206 with a retainer member 202. They are reciprocally movable in a horizontal direction along shafts 211. In this example, the head cartridge 205 integrally comprises a printing head h and an ink tank as an ink supplying source. Ink ejected from the printing head h in a direction of arrow in the figure reaches a printing medium 209, whose print surface is restricted by a platen 210 and spaced a small distance from the printing head h, to form an image on the medium.

An ejection signal according to image data is supplied from a data supply source to the printing head h through a cable 207 and terminals connected to the cable. Designated 208 is a motor for moving (main-scanning) the carriage 206 along the shafts 211 and which may be a pulse motor. Denoted 203 is a wire to transmit a driving force of the motor 208 to the carriage 206. Reference number 201 represents a line feed (LF) motor that connects to a platen roller 210 to feed the printing medium 209 (sub-scan). Reference number 204 indicates a home position (HP) sensor to detect a home position of the carriage 206 in the main scan direction.

According to the color and density of ink and a resolution, one or more head cartridges 205 may be provided. In the example shown, two head cartridges are used. The printing head h may be of a type that ejects ink by thermal energy and may use electrothermal transducers (ejection heaters) that are energized to generate the thermal energy and thereby cause a film boiling in the ink. That is, the printing head h performs printing by causing a film boiling in the ink by thermal energy applied by the ejection heater to form a bubble and utilizing a pressure of the bubble to eject an ink droplet from an ejection opening. The ejection openings, liquid paths communicating with the ejection openings, and ejection heaters installed in the liquid paths (these are also referred to generally as nozzles) constitute printing elements.

Figure 2:
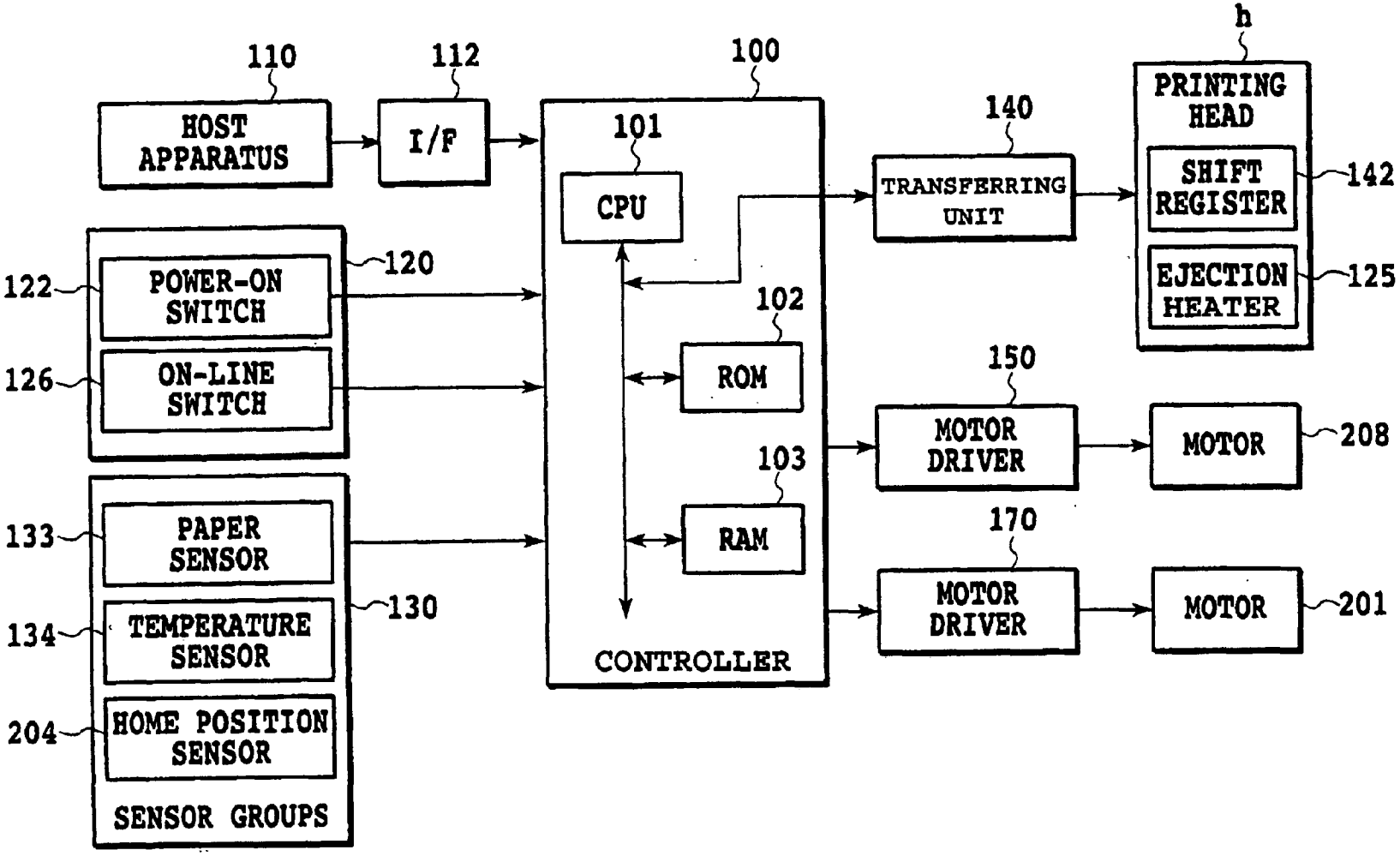
FIG. 2 is a block diagram showing an example outline configuration of a control circuit in the ink jet printing apparatus of FIG. 1.

FIG. 2 is a block diagram showing an outline configuration of a control circuit in the ink jet printing apparatus of FIG. 1.

In FIG. 2, a controller 100 is a main control unit, which comprises: for example, a CPU 101 in the form of a microcomputer; a ROM 102 storing programs, tables and other fixed data; and a RAM 103 which has an area for mapping image data supplied from a host apparatus 110, a print buffer area for mapping print data to be transferred to the printing head h and other work areas.

The host apparatus 110 is a source for supplying image data, and may be provided in the form of a computer for generating and processing data such as an image to be printed or a reader for reading an image, or a digital camera. Image data, command and status signals are transferred to and from the controller 100 through an interface (I/F) 112.

An operation unit 120 has a group of switches for accepting command inputs from an operator, including a power switch 122 and an online switch 126 for setting the online connection of the printing apparatus with the host apparatus 110.

Denoted 130 is a group of sensors, including the home position sensor 204, a paper end sensor 133 for detecting the presence or absence of a printing medium, and a temperature sensor 134 installed at an appropriate location for detecting an ambient temperature.

The printing head h has nozzles arrayed in a direction different from the main scan direction, e.g., in a sub-scan direction, a shift register 142 for arranging nozzle drive data for individual nozzle positions, a latch circuit for latching arranged data, and a transistor circuit for driving the nozzles according to the latched data at appropriate timings. Designated 140 is a transfer unit which serially transfers print data mapped in the print buffer in the RAM 103 to the shift register 142 of the printing head h according to appropriate clocks.

Denoted 150 is a motor driver for driving the main scan motor 208; and reference number 170 is a motor driver for driving the line feed (LF) motor 201. The driving amount of the LF motor 201 can be changed according to the resolution of a print. The driving amount of the LF motor 201 can be set to an amount corresponding to a sum of an amount smaller than the nozzle pitch and an amount of an integer multiple of the nozzle pitch. It is also possible to prepare a plurality of drive amounts for the LF motor 201 and combine these drive amounts. Further, their combination can be determined arbitrarily. This can be done by the motor driver 170 according to the control from the CPU 101.

Figure 3:
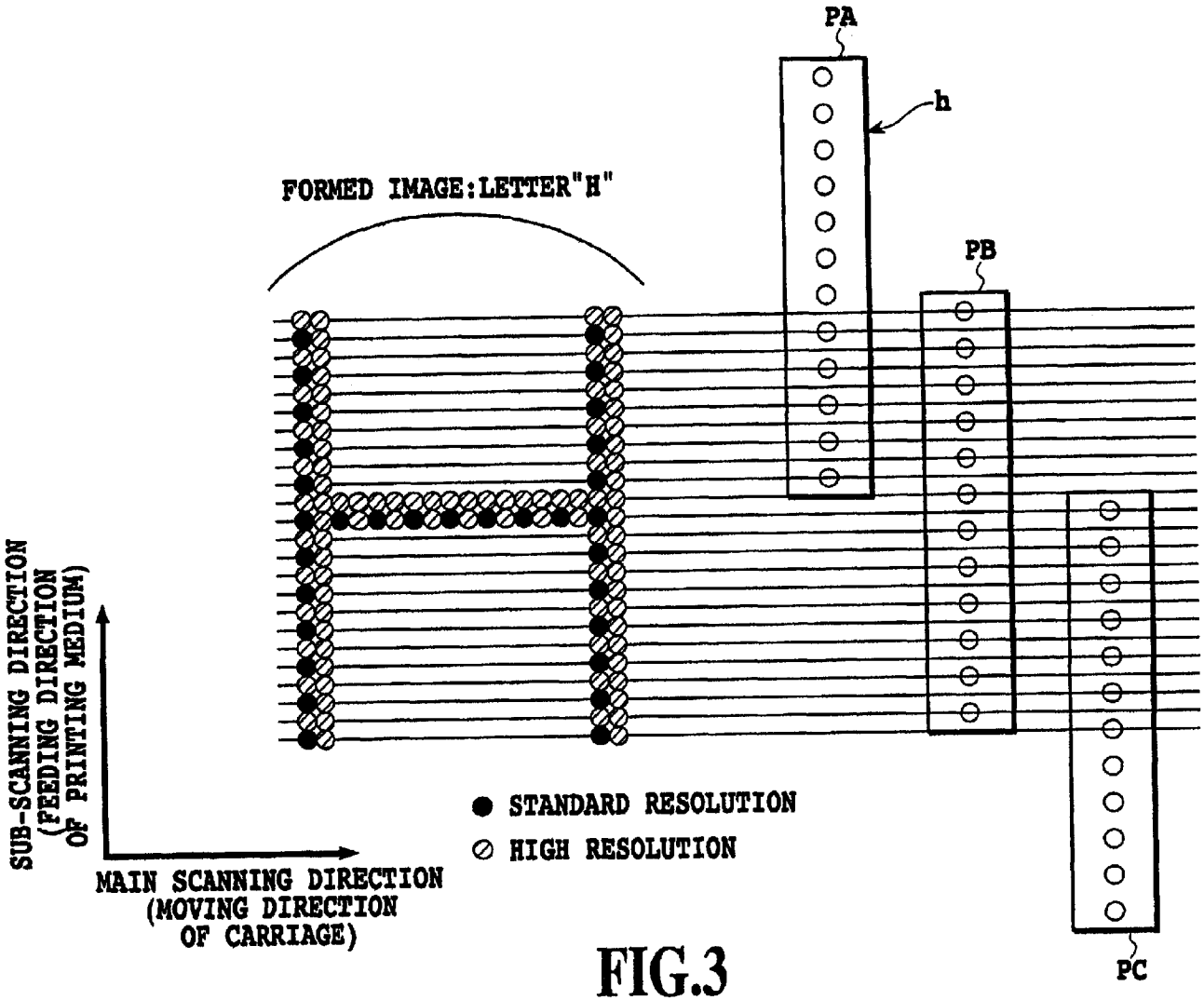
FIG. 3 is an explanatory diagram showing an outline of control to realize a higher resolution than a nozzle pitch or printing element pitch in the head.

With reference to FIG. 3, an outline of the control to realize a high resolution in the sub-scan direction, i.e., to realize a higher resolution than the printing element pitch (nozzle pitch) of the printing head, will be described. As for the main scan direction, a high resolution can be achieved by controlling the timing of ejecting ink from the nozzles during the main scan operation of the printing head h.

FIG. 3 illustrates how a high resolution image of a letter "H" is formed by the printing head h by changing its relative position in the sub-scan direction and performing three main scans (carriage movements) over the same area of the printing medium. Although in the figure the printing head h is shown to have 12 nozzles arranged in a direction matching the sub-scan direction (printing medium feeding direction), the nozzles may be arranged otherwise, for example, in a direction at an angle to the sub-scan direction. It is also noted that the number of the nozzles is not limited to that shown in the example.

In the example shown, during the normal or standard printing in which the nozzle pitch is used as the print resolution, a first main scan (pass PA) over the print area on the printing medium forms dots at positions indicated by black dots, thereby an upper half of the letter "H" is printed. Then, the printing medium is fed in the sub-scan direction by an amount equal to 12 times the nozzle pitch (12 dots), i.e., a total length of the nozzle array. A second main scan (pass PC) forms dots at positions indicated by black dots, thereby a remaining lower half of the letter "H" is printed to complete the image of the letter "H".

To realize a resolution two times higher than the nozzle pitch, a pass PB is interposed between the normal passes PA and PB and the following control is performed. First, the first main scan or pass PA is carried out to form dots at positions indicated by black dots covering the upper half of the letter "H". Then the printing medium is fed in the sub-scan direction by an amount equal to (6+½) dots to situate the nozzles of the printing head h at centers between the standard resolution dot formation positions. Then, a second main scan or pass PB prints interpolated data for high resolution in the sub-scan direction (in the letter "H" the interpolated dots are indicated by hatched dots adjacent in the sub-scan direction to the standard resolution position black dots). After this, the printing medium is fed in the sub-scan direction by an amount equal to (5+½) dots. Then, a third main scan or pass PC forms dots at the standard resolution positions indicated by black dots covering the lower half of the letter "H" to complete the image. In each of the passes PA, PB and PC, the ejection frequency of the nozzles during the main scan is doubled to form dots to realize the two times higher resolution in the main scan direction (those dots shown hatched and located adjacent in the main scan direction to the standard resolution position dots and the interpolated position dots).

Figure 4:
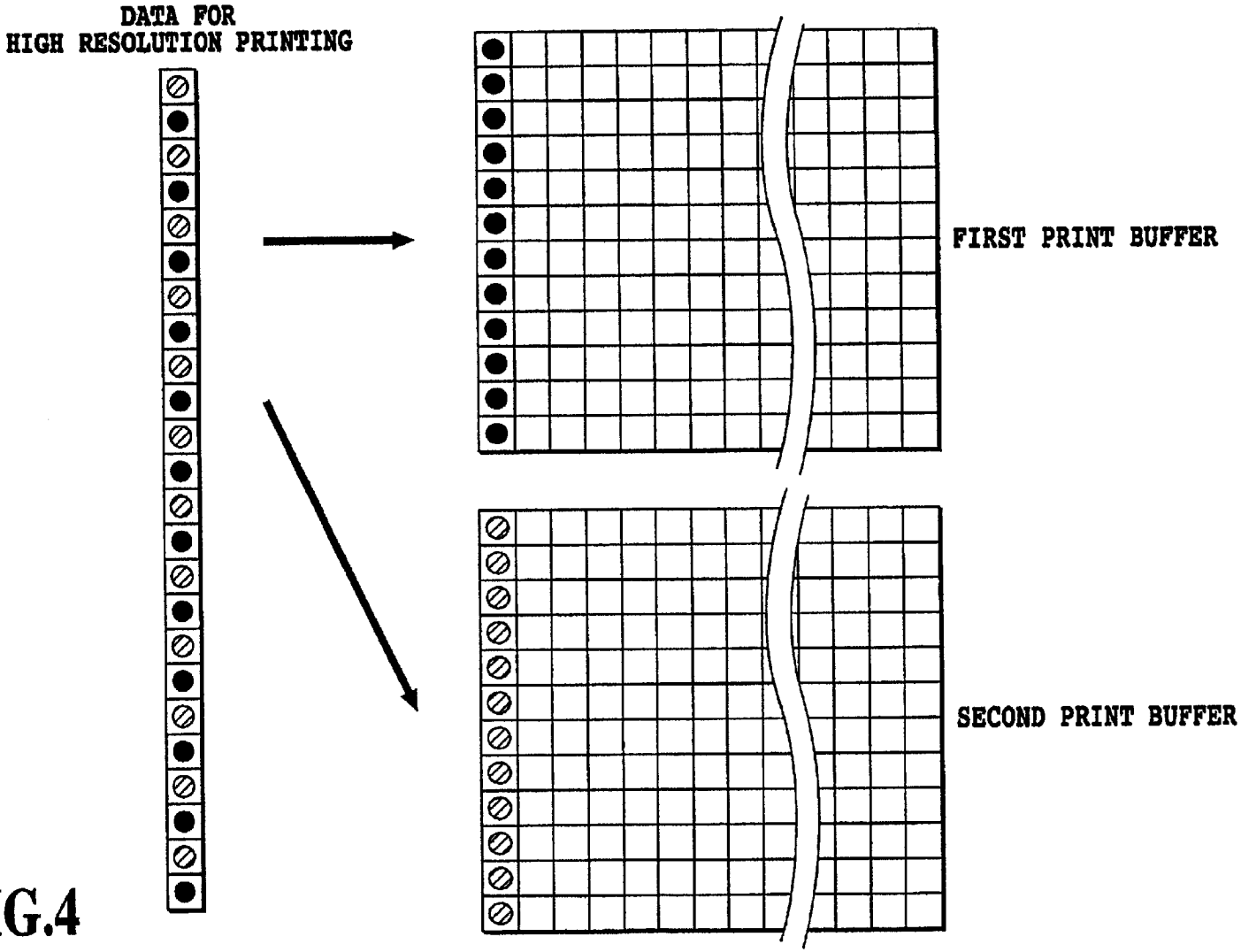
FIG. 4 is an explanatory diagram showing print buffers used in performing a printing operation such as shown in FIG. 3.

FIG. 4 shows the print buffers used in performing the printing operation described above. The print buffers are formed for each main scan of the printing head. When image data for a high resolution is transferred from the host apparatus 110, it is distributed into two print buffers. One is a first print buffer having data corresponding to a standard resolution in the sub-scan direction (indicated by black dots in the figure) and data for a high resolution in the main scan direction, and the other is a second print buffer having interpolation data to realize a high resolution print in the sub-scan direction (indicated by shaded dots in the figure) and data for a high resolution in the main scan direction.

In the conventional control, these two print buffers need to be formed according to the feeding amount. Hence, there may be a case where, depending on the feeding amount determined by a resolution, a data position change in the feeding direction of less than one byte or 8 nozzles may be required. When, for example, a resolution two times the standard one in the sub-scan direction is to be achieved by the method explained in FIG. 3, the sub-scan by an amount of (6+½) dots and the sub-scan by an amount of (5+½) dots are performed alternately. Thus, in matching the data with the corresponding nozzles that form dots according to the data, the data position must be changed by an amount of less than one byte, a basic unit for data processing by computers. This requires the data mapped in the print buffer to be edited again for each pass. In this embodiment, on the other hand, it is possible to form a print buffer without regard to the feeding amount and freely match the print data to the nozzle positions in the printing head, thus avoiding the trouble of data re-editing.

Figure 5:
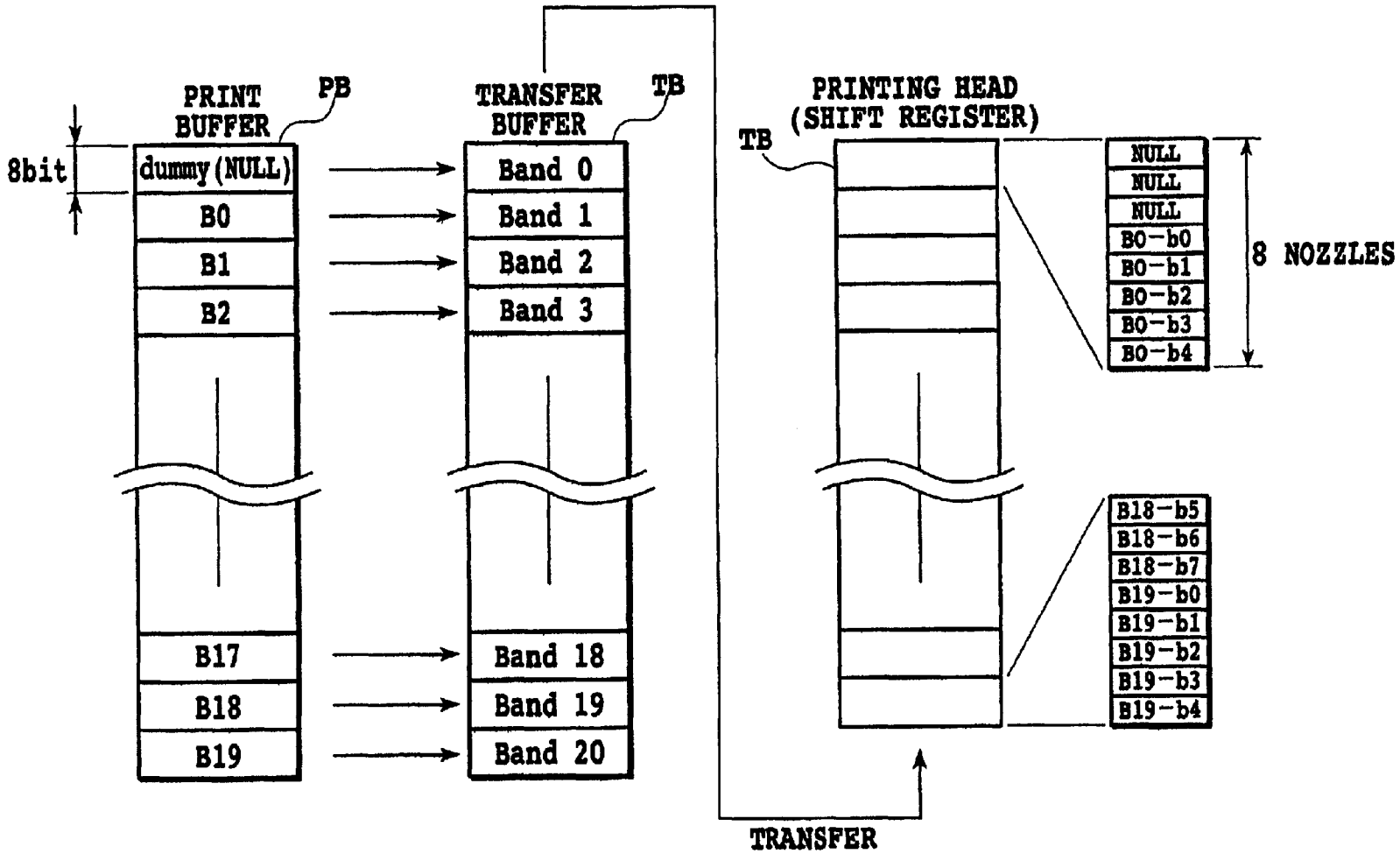
FIG. 5 is an example outline configuration of a print buffer and other components as one embodiment of the present invention for performing a control to set print data at desired nozzle positions in the printing head.

FIG. 5 shows an example outline configuration of the print buffer and others to realize such a control. In this figure, denoted PB is a print buffer formed in the RAM 103 and TB signifies a transfer buffer formed in the transfer unit 140 to transfer data supplied from the print buffer PB to the printing head h. A plurality of nozzles in the printing head h, beginning from a nozzle situated at an end of the nozzle array (e.g., an end on the most upstream side in the printing medium feeding direction), are divided into 20 bands each having 8 nozzles and managed.

The print buffer PB in this embodiment has 20 areas B0–B19 of one byte (8 bits) each, arranged in the sub-scan direction, in which image data is mapped according to the nozzle arrangement of the printing head h. The print buffer PB also has at its top a dummy data area Dummy to ensure that the printing head h executes an appropriate printing operation according to the feeding amount of less than one byte (8 nozzles). The dummy data area Dummy has a size of one byte in the sub-scan direction. The transfer buffer TB has 21 areas Band0–Band20 of one byte (8 bits) each.

In this configuration, dummy data (null data) on the area Dummy is normally not set in the transfer buffer TB. One byte data in the area B0 of the print buffer PB is set in the area Band0 of the transfer buffer TB and then assigned to the upper 8 nozzles in the printing head h. Next, one byte data in the area B1 of the print buffer PB is set in the area Band1 of the transfer buffer TB and assigned to the next 8 nozzles in the printing head h, and so on.

On the other hand, when a data position change of less than 8 nozzles is required by a feeding amount set and thus the dot position correction becomes necessary, the data in the area Dummy, area B0, . . . , area B19 of the print buffer PB are set in the area Band0, area Band1, . . . , area Band20, respectively. At the same time, the number of clocks used to transfer data to the shift register 142 on the printing head h is reduced by an amount necessary for the dot position correction, thereby correcting the position of the data to be set in the printing head h.

That is, when a data position change corresponding to three nozzles is required, for example, the number of transfer clocks is reduced by "3" in transferring data from the areas Band0–Band20 of the transfer buffer TB. Since the amount of data is larger than the number of nozzles of the printing head h by the amount of dummy data, the upper three bits of the dummy data are pushed out of the shift register, so that null data is set in the top three nozzles of the printing head h and the data corresponding to the image data is set in the subsequent nozzles. As a result, the print data can be allocated to appropriate nozzle positions in the printing head without re-editing of the print buffer.

It is noted that not all of the data transferred from the last area B19 of the print buffer is printed. This may be dealt with by, for example, clearing only the data area in the print buffer that is already printed and printing the unprinted data in the next pass.

Figure 6:
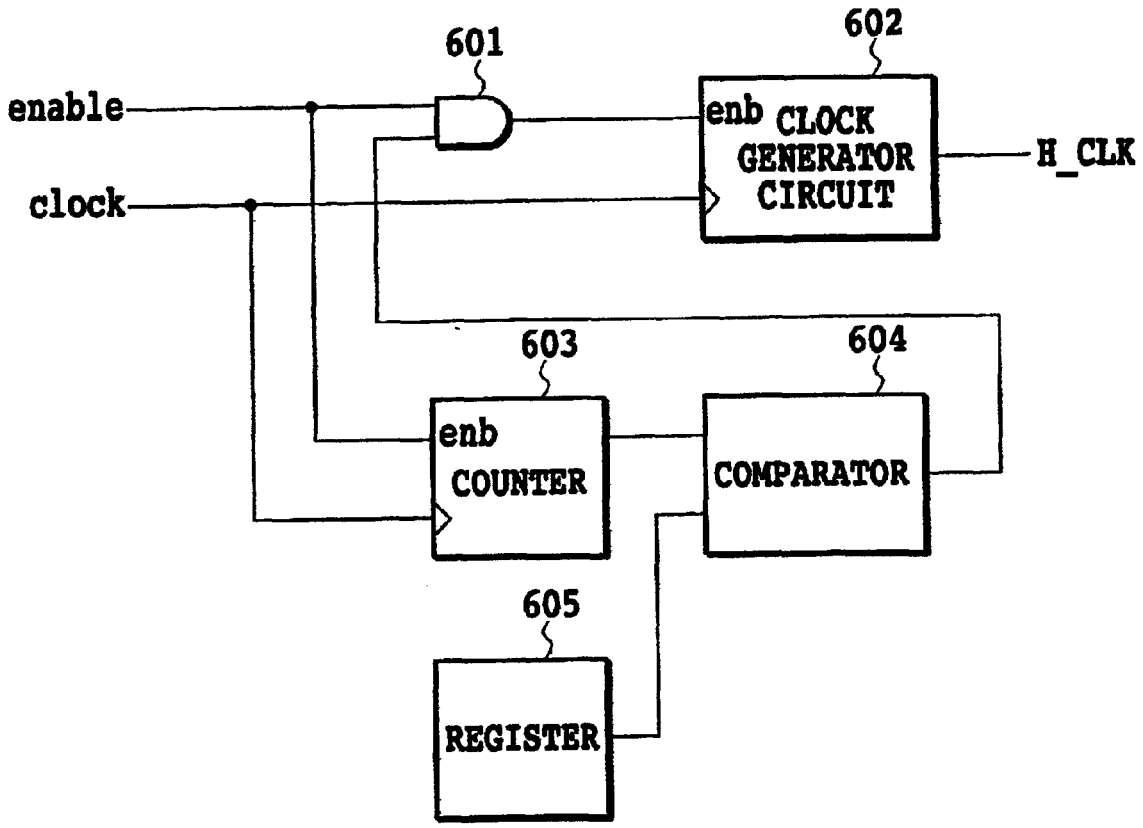
FIG. 6 illustrates an example circuit configuration for controlling the number of data transfer clocks in connection with the configuration of FIG. 5.

FIG. 6 shows an example circuit configuration for performing the control of the number of clocks described above.

Reference number 602 designates a circuit to generate a clock H_CLK for transferring data to the printing head h (shift register). Denoted 603 is a counter for counting the number of base clocks CLK; 604 is a comparator for comparing the count value with a value stored in a register 605; and 601 is an AND circuit for controlling, based on an output signal from the comparator 604, an enable signal that permits the circuit 602 to generate the head clock H_CLK.

Figure 7:
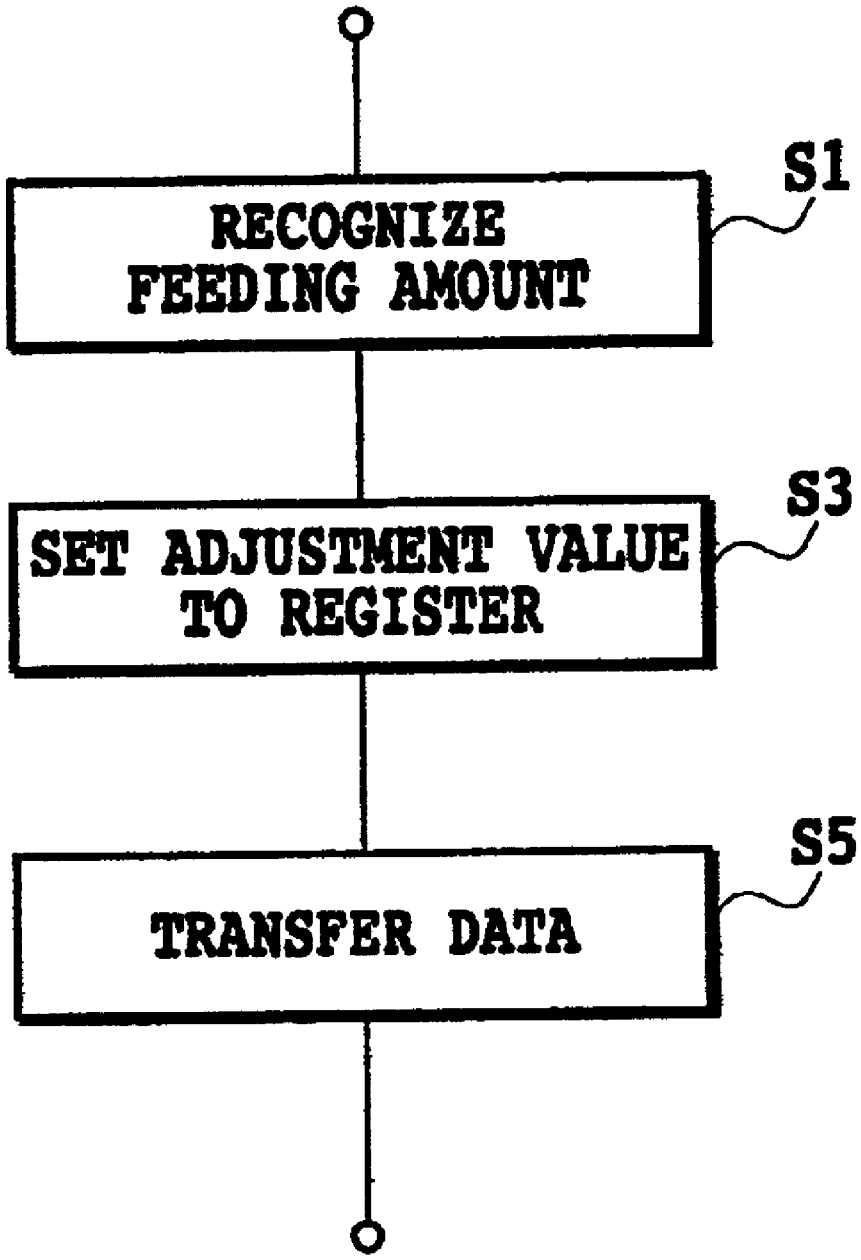
FIG. 7 is a flow chart showing a sequence of steps for making a desired data setting in the control circuit of FIG. 5.

FIG. 7 shows an outline of a control procedure performed by the circuit described above.

According to the feeding amount recognized (step S1), the CPU 101 stores the number of clocks to be transferred in the register 605 (step S3). Then the data transfer is carried out (step S5). The comparator 604 turns off an output signal when the number of clocks transferred matches the stored value in the register, thereby turning off the enable signal connected to the head clock generation circuit 602 to stop the clock.

While the foregoing description mainly concerns the high resolution printing in the printing medium feeding direction (sub-scan direction), the high resolution printing can also be realized without a problem in the main scan direction of the printing head because the printing can be done at any position by controlling the timings of ejecting ink droplets from the associated nozzles.

Further, in the example above, only when a need arises to perform dot position corrections of less than 8 nozzles, performed is a sequence of steps which involves setting the data of areas Dummy, B0, . . . , B19 of the print buffer into the corresponding areas Band0, Band1, . . . , Band20 of the transfer buffer TB and reducing the number of clocks used to transfer data to the shift register 142 in the printing head h by an amount necessary for the dot position correction. If, during the normal operation also, the similar setting is made and the clocks are generated so as to transfer all the data of the areas Band0, . . . , Band20 in the transfer buffer TB, there is no problem because the upper 8 bits of the dummy data are pushed out of the shift register.

In the above example, a configuration has been described in which the dummy data area is provided in the print buffer PB. It is also possible to provide means for generating dummy data only on the transfer unit side so that the dummy data can be transferred before transferring the intended image data and to control the number of clocks according to the position correction in a similar manner described above. In this case, an area for generating the dummy data may be fixedly located on the upper side of the transfer buffer.

Further, while in the example above the dummy data has been described to be 8 bits long in the sub-scan direction, the number of bits of the dummy data can of course be set to any appropriate value according to the amount of position correction.

Further, although the above embodiment has described a case in which the present invention is applied to an ink jet type printing apparatus that forms an image by ejecting ink droplets from the printing head onto a printing medium, the present invention is not limited to this construction. The present invention can also be effectively applied to other types of printing apparatus, such as thermal type and heat transfer type, as long as a printing medium is fed relative to the printing head.

As described above, with this invention, since there is no need to form print buffers anew for each feeding amount of the printing medium, the software development becomes easier than in the conventional techniques. Further, a temporary storage area (RAM) that has conventionally been required for the re-editing of the print buffers is not necessary.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus for performing a printing operation by using a printing head having an array of a plurality of printing elements, said printing apparatus comprising:

feeding means for feeding a printing medium relative to the printing head;

feed control means for driving said feeding means to feed the printing medium and for controlling said feeding means to change a feeding amount of the printing medium;

transfer means for transferring print data to the plurality of printing elements to cause the printing head to perform the printing operation; and transfer control means for adding predetermined blank data to the print data to be transferred and for changing the number of clocks for transferring the print data based on the feeding amount of the printing medium.

2. A printing apparatus as claimed in claim 1, further comprising means for scanning the printing head relative to the printing medium in a direction different from that of the array of the printing elements, and wherein said feeding means feeds the printing medium in a direction perpendicular to the scanning direction.

3. A printing apparatus as claimed in claim 1, wherein the feed control means changes the feeding amount based upon a resolution of printing.

4. A printing apparatus as claimed in claim 3, wherein said feed control means sets the feeding amount of said feeding means to match a feeding amount less than a pitch of the printing elements in the printing head added to an integer multiple of the printing element pitch.

5. A printing apparatus as claimed in claim 4, wherein said feed control means can set the feeding amount by selecting from among a plurality of predetermined feeding amounts.

6. A printing apparatus as claimed in claim 5, wherein the feed control means is capable of combining two or more of the predetermined feeding amounts as the set feeding amount.

7. A printing apparatus as claimed in claim 1, wherein, when shifting the positions of data to be set in the plurality of printing elements by an amount less than a predetermined value in response to the changing of the feeding amount, said transfer control means adds the predetermined amount of blank data to the print data to be transferred and reduces the number of clocks by an amount corresponding to a shifting amount of the positions of data.

8. A printing apparatus as claimed in claim 7, wherein the predetermined value is 8 bits, a unit used for data processing.

9. A printing apparatus as claimed in claim 1, wherein said printing head is in the form of an ink jet printing head for performing printing by ejecting an ink.

10. A printing apparatus as claimed in claim 9, wherein said ink jet printing head has heating elements for generating thermal energy to make the ink film-boil in order to eject the ink.

11. A printing apparatus for performing a printing operation by using a printing head having an array of a plurality of printing elements, said printing apparatus comprising:

feeding means for feeding a printing medium relative to the printing head;

a print buffer for storing a sequential, predetermined amount of blank data and print data in the form of units of a predetermined number of bits;

a transfer buffer for storing read-out data from said print buffer in the form of units of the predetermined number of bits;

feed control means for controlling said feeding means to feed the printing medium by a feeding amount less than a range of the array of the printing elements corresponding to the predetermined number of bits;

transfer means for transferring print data to the plurality of printing elements from said transfer buffer; and transfer control means for, when a changing amount of positions of print data set in the printing elements based on the feeding amount is less than the predetermined number of bits, causing the blank data to be stored from a top end of said transfer buffer, the print data to be stored in an area following an area where the blank data was stored, and the blank data and the print data to be transferred based on a number of clocks according to the feeding amount.

* * * * *